US009380833B2

(12) United States Patent
Irving et al.

(10) Patent No.: US 9,380,833 B2
(45) Date of Patent: Jul. 5, 2016

(54) SHOE INSERT

(71) Applicants: Diana Irving, Oakland Park, FL (US); James Irving, Oakland Park, FL (US)

(72) Inventors: Diana Irving, Oakland Park, FL (US); James Irving, Oakland Park, FL (US)

( * ) Notice: Subject to any disclaimer, the term of this patent is extended or adjusted under 35 U.S.C. 154(b) by 534 days.

(21) Appl. No.: 13/892,610

(22) Filed: May 13, 2013

(65) Prior Publication Data

US 2014/0013619 A1 Jan. 16, 2014

Related U.S. Application Data

(60) Provisional application No. 61/670,651, filed on Jul. 12, 2012.

(51) Int. Cl.

| | |
|---|---|
| ***A43B 3/26*** | (2006.01) |
| ***A43B 19/00*** | (2006.01) |
| ***A43B 7/14*** | (2006.01) |
| ***A43B 1/00*** | (2006.01) |
| ***A43B 3/30*** | (2006.01) |

(52) U.S. Cl.

CPC ..... *A43B 19/00* (2013.01); *A43B 1/0081* (2013.01); *A43B 3/26* (2013.01); *A43B 3/30* (2013.01); *A43B 7/1465* (2013.01)

(58) Field of Classification Search

CPC ..... A43B 3/26; A43B 3/30; A43B 5/0427; A43B 7/26; A43B 7/1465; A43B 1/0081

USPC ..... 36/97, 94, 8.4

See application file for complete search history.

(56) References Cited

U.S. PATENT DOCUMENTS

| | | | | |
|---|---|---|---|---|
| 4,503,628 | A | 3/1985 | Mancinelli | |
| 5,740,618 | A * | 4/1998 | Minden | A43B 5/12 36/71 |
| 6,082,027 | A * | 7/2000 | Wagonhurst | A43B 3/26 36/117.6 |
| 6,442,874 | B1 * | 9/2002 | Long | A43B 3/26 36/112 |
| 6,584,707 | B1 * | 7/2003 | Racine | A43B 3/26 36/112 |
| 6,954,997 | B2 | 10/2005 | Melbock | |
| 7,568,299 | B2 | 8/2009 | Denha | |
| D608,532 | S | 1/2010 | Novins | |
| 7,827,707 | B2 | 11/2010 | Davis | |
| 8,117,768 | B2 | 2/2012 | Bobbett | |
| 8,181,362 | B2 | 5/2012 | Davis | |
| 8,463,657 | B1 * | 6/2013 | Bentvelzen | A43B 1/0081 36/25 R |
| 2006/0059726 | A1 * | 3/2006 | Song | A43B 7/142 36/142 |
| 2006/0210751 | A1 * | 9/2006 | Cunningham | A43B 1/0027 428/40.1 |
| 2007/0283598 | A1 | 12/2007 | Gray | |
| 2009/0193683 | A1 | 8/2009 | Igdari | |
| 2010/0251568 | A1 | 10/2010 | Haruda | |
| 2011/0099845 | A1 * | 5/2011 | Miller | A43B 7/142 36/91 |

* cited by examiner

*Primary Examiner* — John Kavanaugh

(74) *Attorney, Agent, or Firm* — Allen Dyer Doppelt Milbrath & Gilchrist

(57) ABSTRACT

A toe engaging apparatus or shoe insert includes one or more layers. Each layer is removably held to a neighboring planar layer. Each of the layers have a thickness, a longitudinal length, and a height; the height being such that the layers fits against a front wall of a target shoe. The layers are sized and shaped such that when affixed to the front wall area of the target shoe, the layers reduce the internal length of the target shoe, thereby effectively decreasing the size of the target shoe. The toe engaging apparatus optionally includes a mechanism for holding the plurality of layers against the front wall of the target shoe.

6 Claims, 5 Drawing Sheets

SHOE INSERT

CROSS-REFERENCE TO RELATED APPLICATION

This application is a non-provisional application of U.S. patent application Ser. No. 61/670,651, filed Jul. 12, 2012, the disclosure of which is hereby incorporated by reference.

FIELD

This invention relates to the field of footwear and, more particularly, to a shoe insert for installation in the front portion of a shoe to adjust the amount of interior distance between the wearer's toes and a forward and/or side surface of the shoe.

BACKGROUND

Footwear differs in type and style including dress shoes, casual shoes, athletic shoes, work shoes, boots, dance shoes, and the like. Although there are standards for footwear sizing, footwear is produced by a wide array of domestic and international manufacturers creating substantial inconsistencies in the sizing between similar footwear styles. Materials used in the construction of footwear also provide varying degrees of stretching and size shifting throughout the life of the footwear.

In addition to the production and wear variances in footwear, the wearer of footwear creates many additional sizing challenges. Such challenges include the typical uniqueness and size variation between a wearer's left and right foot, changes in body weight, disease or injury, and the wearers' walking/running habits. The growth of the children, infant's, and teen's feet requires sizing changes at a higher frequency than that of an adult.

What is needed is a shoe insert that adjusts the size of footwear to match the size of the wearer's foot.

SUMMARY

In one embodiment, a shoe insert or toe engaging apparatus is disclosed including several layers. Each layer is removably held to a neighboring layer. Each of the layers have a thickness, a longitudinal length, and a height; the height being such that the layers fits against a front wall of a target shoe. The layers are sized and shaped such that when affixed to the front wall of the target shoe, the layers reduce the internal length (and optionally width) of the target shoe, thereby effectively decreasing the size of the target shoe. The toe engaging apparatus includes a mechanism for holding the plurality of layers against the front wall of the target shoe.

In another embodiment, a method of reducing a size of a target shoe is disclosed including providing a target shoe, the target shoe having a front area wall; and providing a toe engaging apparatus having several layers. Each layer is removably held to a neighboring layer by punches. Each of the layers have a thickness, a longitudinal length, and a height; the height being such that the layers fits against a front wall of a target shoe. The layers are sized and shaped such that when affixed to the front wall of the target shoe, the layers reduce the internal length (and optionally width) of the target shoe, thereby effectively decreasing the size of the target shoe. A number of the layers needed to properly reduce the size of the target shoe to a desired size is determined and one or more of the layers is removed until the number of remaining layers is equal to the number of layers needed to properly reduce the size of the target shoe to the desired size. The toe engagement apparatus is then installed against the front wall of the target shoe, thereby reducing the effective size of the target shoe without vertically cramping a user's foot.

In another embodiment, a toe engaging apparatus is disclosed including a single layer. The single layer has a thickness, a longitudinal length, and a height; the height being such that the single layer fits against a front wall of a target shoe. The layer is sized and shaped such that when affixed to the front wall of the target shoe, the layer reduces the internal length (and optionally width) of the target shoe, thereby effectively decreasing the size of the target shoe. An adhesive coating is on a surface of the layer for holding the layer to the front wall of the target shoe.

In another embodiment, a toe engaging apparatus is disclosed having either singular or multiple layers and connected to an insole or floor member. Each layer is removably held to a neighboring layer. Each of the layers have a thickness, a longitudinal length, and a height; the height being such that the layers fits against a front wall of a target shoe. The layers are sized and shaped such that when affixed to the front wall of the target shoe, the layers reduce the internal length (and optionally width) of the target shoe, thereby effectively decreasing the size of the target shoe. The toe engaging apparatus includes a mechanism for holding the plurality of layers against the front wall of the target shoe.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
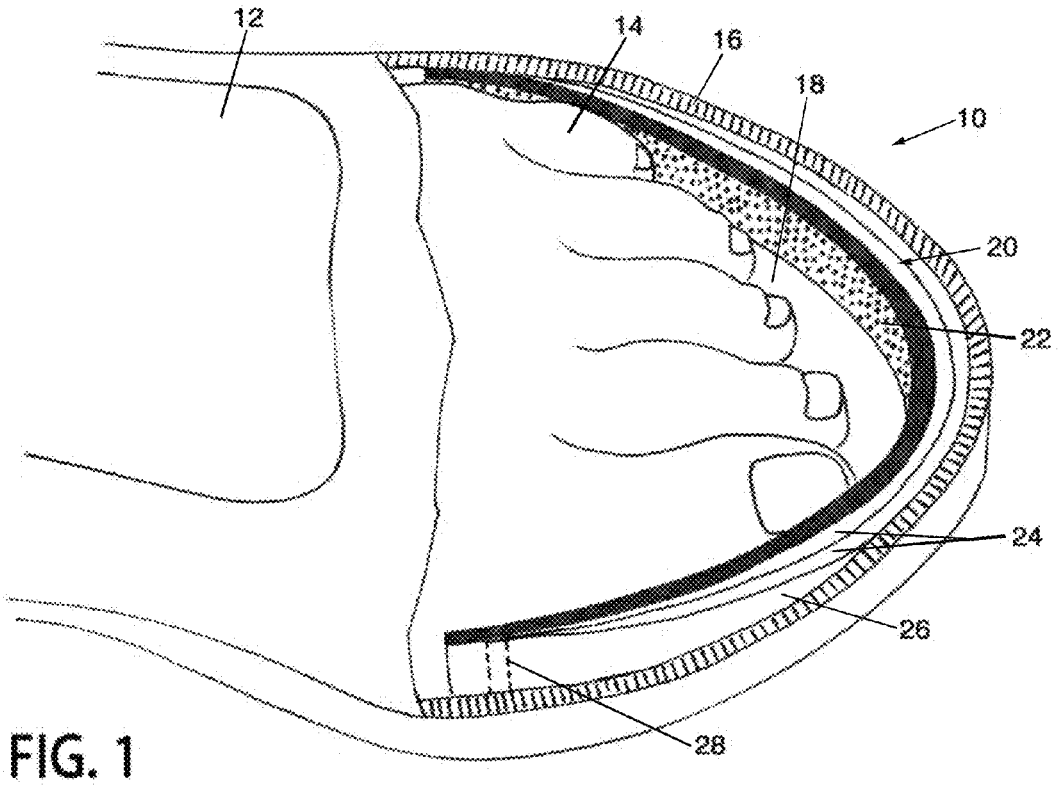
FIG. 1 illustrates a perspective view of a footwear and foot of the wearer of the footwear with a shoe insert that has been inserted into the front portion of the footwear.

Reference will now be made in detail to the presently preferred embodiments of the invention, examples of which are illustrated in the accompanying drawings. Throughout the following detailed description, the same reference numerals refer to the same elements in all figures. Throughout this description, the term footwear refers to any type, style, mode of footwear, including, but not limited to: shoes, dress shoes, casual shoes, athletic shoes, work shoes, boots, dance shoes, sandals, running shoes, work boots, etc.

Referring to FIG. 1, a perspective view of a shoe 10 and foot 12 of the wearer of the footwear with a shoe insert 20 that has been inserted into the front portion of the footwear 10 is shown. In all examples, the front portion 16 and sole 18 of the footwear are shown for clarity reasons.

Often, footwear 10 is manufactured and sold in incremental sizes, the larger size for a larger foot. Each integer size is approximately ⅓ of an inch longer than the next lower size. Some footwear 16/18 are manufactured in half-sizes such as 9½, but often, the larger sizes come only in whole number sizes, not in half-size increments. Due to different manufacturers and types of footwear, there are many sizing inconsistencies.

There are many reasons why particular footwear 10 is not the correct size for the individual's feet 12. In the case of children, infants, and teens, often shortly after buying new shoes, the foot has outgrown the shoes. In the case of adults, often one foot is of a different length (and optionally a different width) than the other foot, or the desired footwear 10 is not available in the size needed or is not available in a needed half-size. To adjust for these variances, the toe engagement apparatus, or shoe insert 20 is placed inside the toe area of the footwear 10, engaging with the wearer's toes and effectively shortening the interior length of the footwear 10 and, optionally, reducing the width of the toe area of the footwear 10. The shoe insert 20 is placed against a front wall 16 of the footwear 10, thereby effectively shortening the interior length (and optionally width) of the footwear 10. By such placement, the shoe insert 20 changes the effective length (and optionally width of the footwear 10, and does not vertically lift or cramp the user's toes 14. In this embodiment, the shoe insert 20 only interfaces to the inside of the toe area of the footwear 10 without raising the sole area 18.

In some embodiments, the shoe insert 20 is preferably made of layers 22/24/26 of one or more pliable materials. In such, many configurations of layers 22/24/26 are anticipated. For example, in some embodiments, the layer 22 closest to the user's toes 14 is made of a cushion material for comfort while one or more intermediate layers 24 are made from, for example, foam, fabric, rubber, leather, gel, carbon, plastic, paper, cork, metal, etc. In some embodiments, an adhesive layer 26 interfaces with the inner surface 16 of the footwear 10 and holds the shoe insert 20 against the inner surface 16, though in other embodiments, the shoe insert 20 is press-fit or held against any surface of the footwear 10, with or without an adhesive.

In some embodiments, the shoe insert 20 is integrated into the footwear 10 during manufacture of the footwear 10 and the shoe insert 20 is manufactured as part of the footwear 10 or added to the footwear 10 in any way known. Thereby, in these embodiments, one purchases the footwear 10 with the shoe insert 20 already installed in the toe area of the footwear 10 and, if the footwear 10 is too small, the purchaser removes one or mover layers 24 until the footwear 10 fits properly.

Even though the shoe insert 20 is shown in a curved configuration in the drawings, it is anticipated that the shoe insert be provided in any configuration, including a linear configuration, then bent to match the curvature and contour of the front walls of the target shoe.

Figure 2:
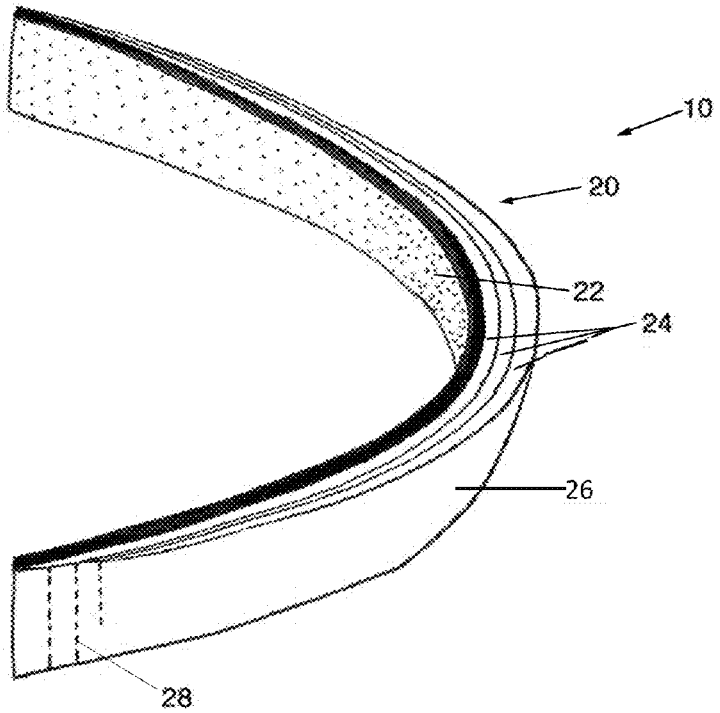
FIG. 2 illustrates a perspective view of the layers of the exemplary shoe insert.

Referring to FIG. 2, a perspective view of the layers 22/24/26 of the exemplary shoe insert 20 is shown. The shoe insert 20 is preferably made of layers 22/24/26. In such, many configurations of layers 22/24/26 are anticipated. For example, in some embodiments, the layer 22 closest to the user's toes 14 is made of a cushion material for comfort while one or more intermediate layers 24 are made from, for example, foam, fabric, rubber, leather, gel, carbon, plastic, paper, cork, metal, cork, or any similar singular or blended material, etc. As another example, the first layer is a cloth material and/or cushion material, and the subsequent layers are foam, fabric, rubber, leather, gel, plastic, paper, cork, metal, etc. In the later example, it is anticipated to include carbon (e.g. charcoal) in the first layer to reduce odor.

In some embodiments, an adhesive layer 26 is included for holding the shoe insert against, for example, the inner surface 16 of the footwear 10, thereby holding the shoe insert 20 against the inner surface 16. In some embodiments, all sizing layers 22/24 are made of the same material such as foam, fabric, rubber, leather, gel, carbon, plastic, paper, cork, metal, etc.

The layers 22/24 are preferably removably or peelably held to each other by any way known in the industry such as static bond, a weak adhesive material, perforations, hook-and-loop material, fasteners, sewn, magnets, fasteners, Velcro, zippers, etc. In the latter, perforations are made through the layers 22/24 and the material of one layer 22/24 encroaches into the perforations of the next layer 22/24, therefore, holding the adjacent layers 22/24 to each other until one layer 22/24 is peeled from the adjacent layer 22/24. In embodiments in which the outer layer 22/24/26 (the layer 22/24/26 that interfaces with the inside toe area 16 of the footwear 10) is an adhesive layer 26, it is anticipated that the adhesive layer 26 has a protective cover (not shown) to prevent unwanted adhesion. It is also anticipated that each subsequent removable layer 24 includes an adhesive on an outside surface so that as one layer 24 is peeled from the subsequent layer 24, the outside surface of the subsequent layer 24 has an adhesive to bond to the inside toe area 16 of the footwear 10.

To facilitate peeling of the layers 24, in a preferred embodiment, the layer ends 28 are staggered (as shown), providing easy access to the desired number of layers 24 that need to be peeled off.

In one embodiment, the sides of the insert 20 contain perforations allowing the insert length to be adjusted by removing sections of the insert 20.

Figure 3:
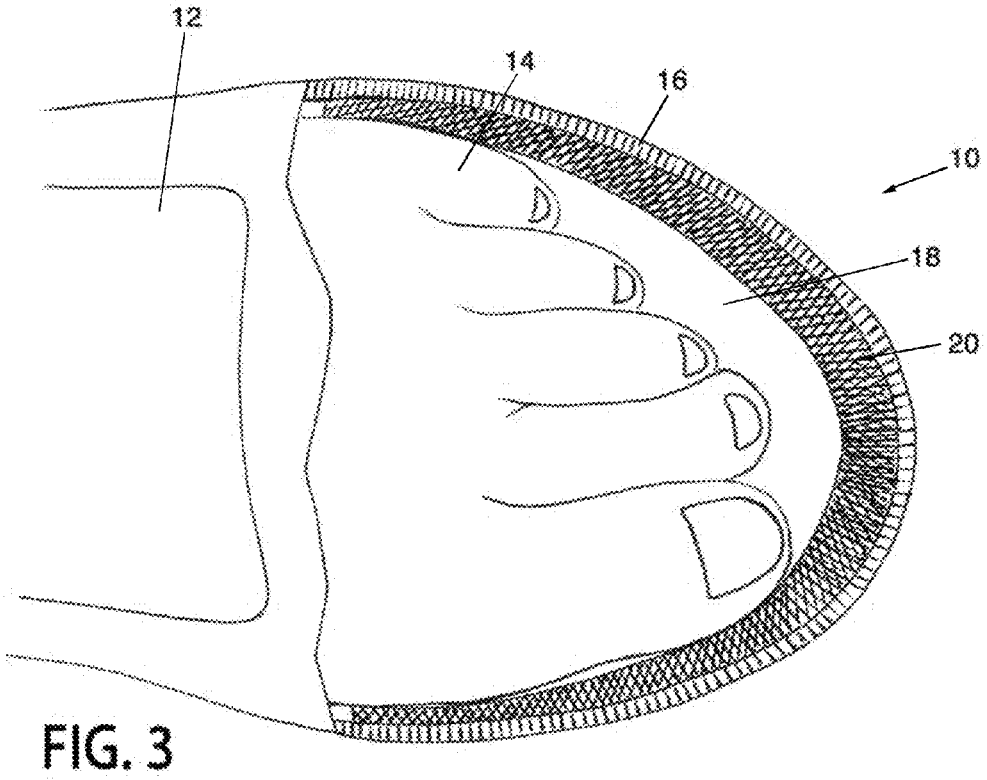
FIG. 3 illustrates a top view of a shoe insert within footwear and the relationship between the shoe insert, the footwear, and foot of the wearer of the footwear.
Figure 4:
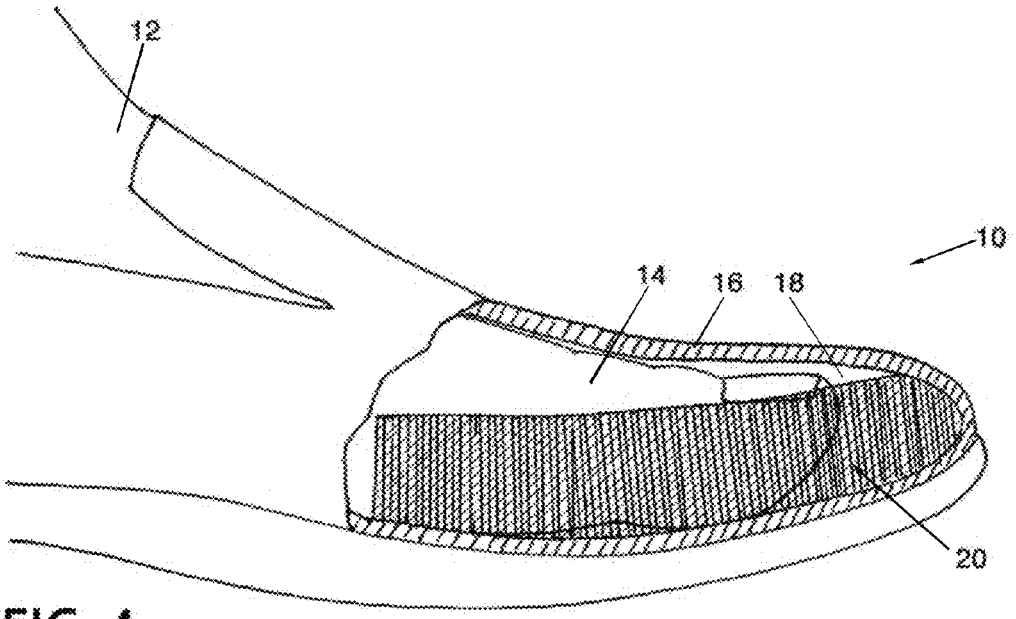
FIG. 4 illustrates a side view of the footwear, the foot of the wearer of the footwear, and the shoe insert.

Referring to FIGS. 3 and 4, a top view (FIG. 3) and side view (FIG. 4) of a shoe insert 20 within footwear 10 and the relationship between the shoe insert 20, the footwear 10, and foot 12 and toes 14 of the wearer of the footwear is shown. In this, the shoe insert 20 shortens the length of the footwear 10 by approximately the overall width of the shoe insert 20. In some embodiments, depending on the linear length of the shoe insert 20, the shoe insert 20 also reduces the width of the footwear 10. Note that, as shown in FIG. 4, some embodiments of the shoe insert 20 are void above and below the user's foot 12 and toes 14 and, therefore, do not reduce clearance above the user's foot 12 and toes 14.

Figure 5:
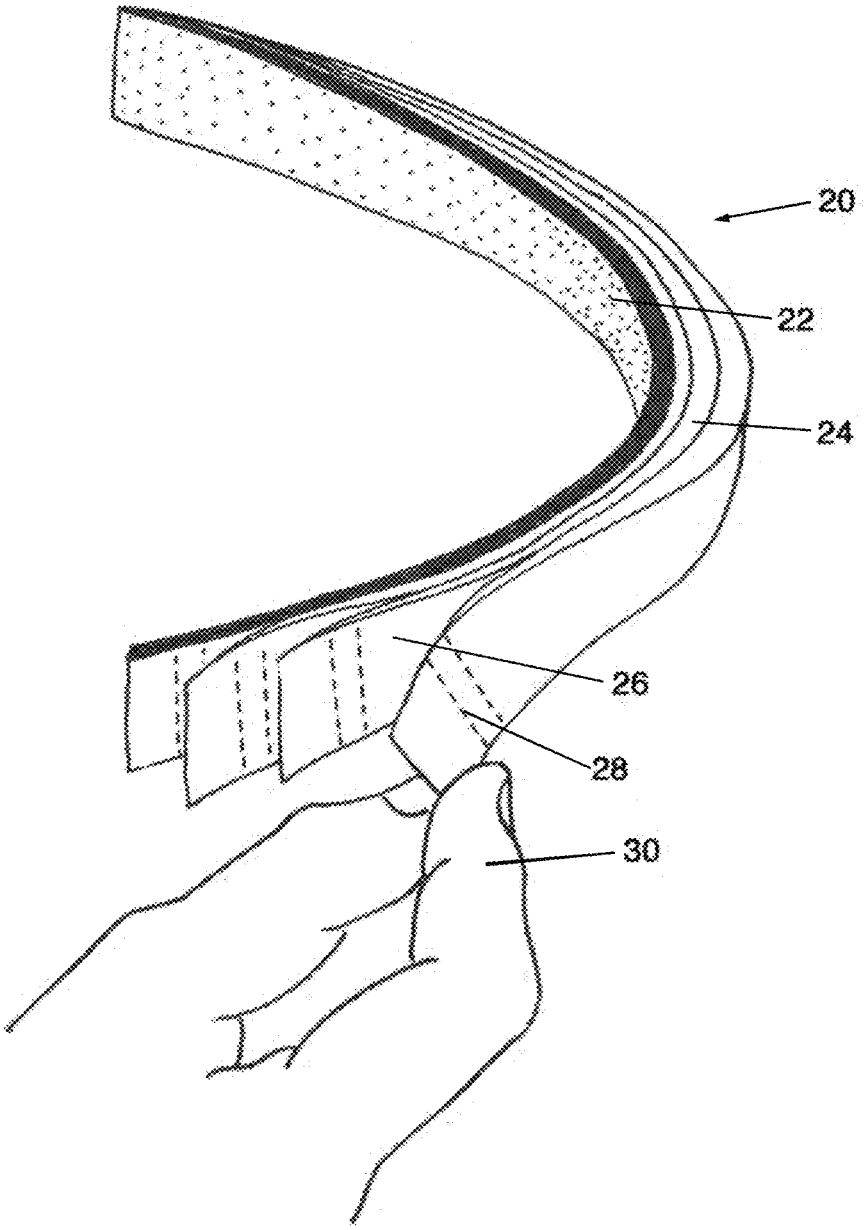
FIG. 5 illustrates a perspective view of the layers of the shoe insert such that the shoe insert layers are readily separated and removed.

Referring to FIG. 5, a perspective view of the layers 22/24/26 of the shoe insert 20 such that the shoe insert layers 22/24/26 are readily separated and removed is shown. In this embodiment, the layer 22 closest to the user's toes 14 is made of a cushion material for comfort while one or more intermediate layers 24 are made from, for example, foam, fabric, rubber, leather, etc. An adhesive layer 26 interfaces with the inner surface 16 of the footwear 10 and holds the shoe insert 20 against the inner surface 16. In some embodiments, all sizing layers 22/24 are made of the same material such as foam, fabric, rubber, leather, gel, plastic, paper, cork, metal, etc. The layers 22/24 are preferably removably or peelably held to each other by any way known in the industry such as static bond, a weak adhesive material, perforations, etc. In the latter, perforations are made through the layers 22/24 and the material of one layer 22/24 encroaches into the perforations of the next layer 22/24, therefore, holding the adjacent layers 22/24 to each other until one layer 22/24 is peeled from the adjacent layer 22/24. In embodiments in which the outer layer 22/24/26 (the layer 22/24/26 that interfaces with the inside toe area 16 of the footwear 10) is an adhesive layer 26, it is anticipated that the adhesive layer 26 has a protective cover (not shown) to prevent unwanted adhesion. It is also anticipated that each subsequent removable layer 24 includes an adhesive on an outside surface so that as one layer 24 is peeled from the subsequent layer 24, the outside surface of the subsequent layer 24 has an adhesive to bond to the inside toe area 16 of the footwear 10.

As shown in FIG. 5, the layer ends 28 are staggered (as shown), providing easy access to removal of the desired number of layers 24 that need to be peeled off.

Figure 6:
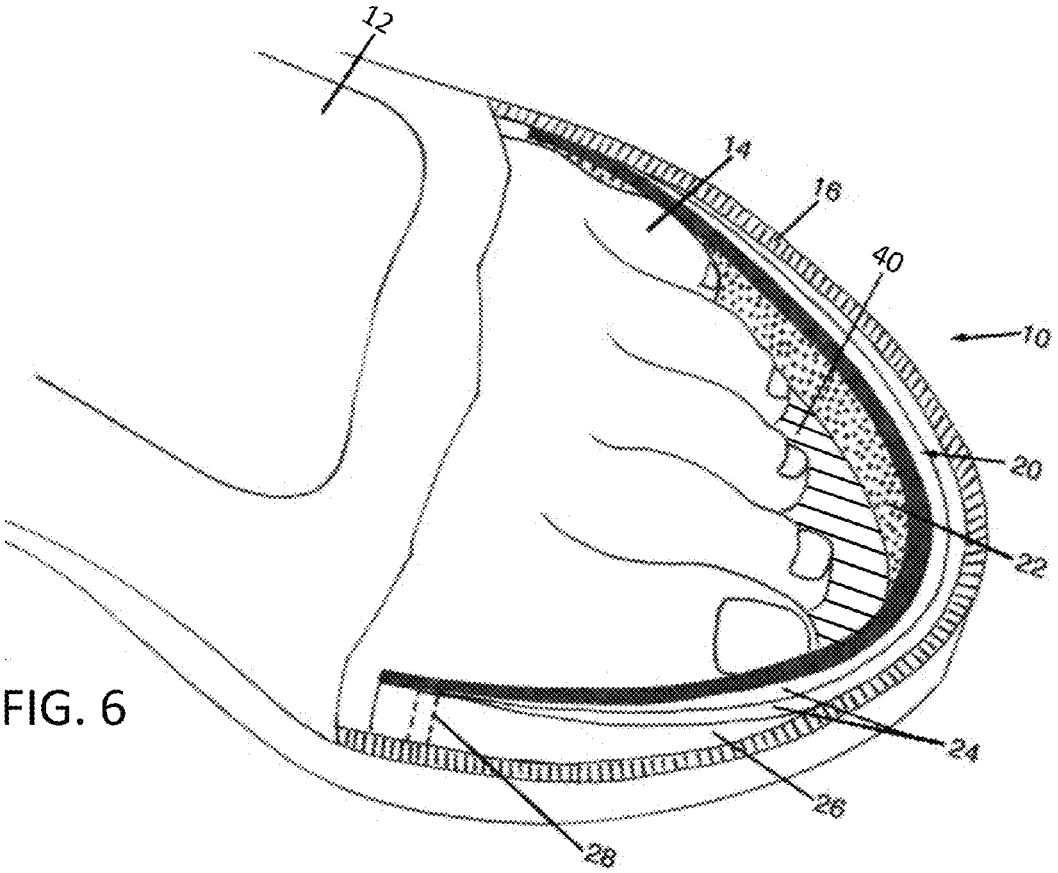
FIG. 6 illustrates a perspective view of a footwear and foot of the wearer of the footwear with a shoe insert that has been inserted into the front portion of the footwear, the shoe insert having a sole-interface surface.

Referring to FIG. 6, a perspective view of a footwear and foot of the wearer of the footwear with a shoe insert that has been inserted into the front portion of the footwear, the shoe insert having a sole-interface surface is shown.

In this embodiment, the shoe insert 20 includes a floor member 40 that simplifies installation. In such, the layers 22/24/26 are connected/formed to a thin insole or floor member 40 improving the process of installing which is performed in a similar manner as one would install a typical shoe insole. Since the layers 22/24/26 are held in place against the toe area wall 16 of the footwear 10 by the floor member 40 (e.g. similar to an insole or partial insole), in some embodiments, there is no adhesive outer layer 26. Once placed inside the toe area of the footwear 10, the layers 22/24 effectively shortening the interior length and/or width of the footwear 10. The shoe insert 20 only changes the effective length and/or width of the footwear 10, and does not vertically lift or cramp the user's toes 14 being that the floor member 40 is fabricated of a thin material such as plastic, paper, cork, paper, foam, rubber, etc.

In some embodiments, a bottom surface of the floor member 40 is coated with an adhesive to adhere the floor member 40 to the inner sole of the target footwear 10. In some embodiments, the floor member 40 is made of a cushion material such as foam, therefore providing additional cushioning the wearer's foot as would a cushioned insole. In some embodiments, the floor member 40 is made of or includes a form of carbon (e.g., charcoal), or other odor absorbing materials to absorb foot odor.

Although not required, the shoe insert 20 of this embodiment is preferably made of layers 22/24/26. In such, many configurations of layers 22/24/26 are anticipated. For example, in some embodiments, the layer 22 closest to the user's toes 14 is made of a cushion or fabric material for comfort while one or more intermediate layers 24 are made from, for example, foam, fabric, rubber, leather, gel, carbon, plastic, paper, cork, metal, etc. In some embodiments, an adhesive layer 26 interfaces with the inner surface 16 of the footwear 10 and holds the shoe insert 20, for example, against the inner surface 16 of the footwear 10.

Figure 7:
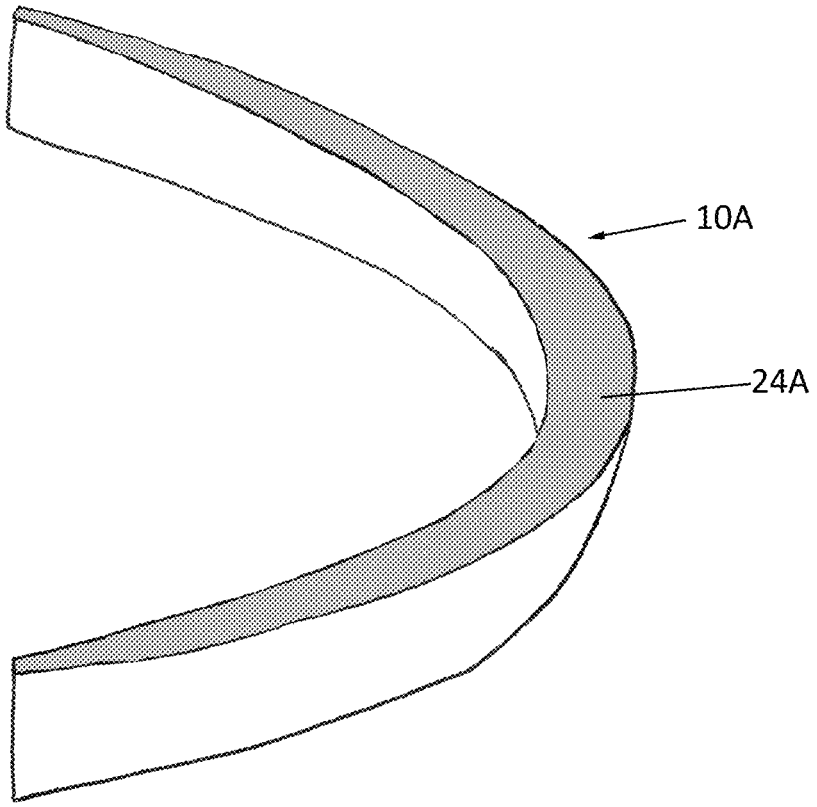
FIG. 7 illustrates a perspective view of a single layer, non-separable monolithic shoe insert.

Referring to FIG. 7, a perspective view of a single non-separable monolithic layer 24 of the exemplary shoe insert 10A is shown. In such, many configurations of the layer 24A are anticipated. For example, in some embodiments, the layer 24A is non-separable and is made of a blended material with a cushion material for comfort closest to the toes 14 and additional materials made from, for example, foam, fabric, rubber, leather, gel, carbon, plastic, paper, cork, metal, cork, or any similar singular or blended material, etc. As another example, the layer 24A is a non-separable layer composed of fabric material closest to the toes 14, followed by charcoal and other materials such as foam, fabric, rubber, leather, gel, plastic, paper, cork, metal, etc.

In some embodiments, an adhesive is added to the singular or blended material and holds the shoe insert 20A against the inner surface 16 of the footwear 10.

Although the present invention has been discussed in relation to a removable shoe insert or toe engaging apparatus, it can be incorporated as a permanent front layer or layers in footwear, such as a shoe or the like, for later removal by the consumer after purchase.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

It will be appreciated that the present invention is not limited to foregoing embodiments and that various changes and modifications can be effected therein by one of ordinary skill in the art without departing from the scope or spirit of the invention as defined by the claims.

What is claimed is:

1. A method of reducing a size of a target shoe using a toe engaging apparatus comprising a plurality of layers, each layer removably held to a neighboring layer, each of the layers having a thickness, a longitudinal length, and a height; the height being approximately equal to a height of front area walls of the target shoe, the method comprising:

determining a number of the layers needed to properly reduce the size of the target shoe to a desired size;

removing one or more of the layers until the number of remaining layers is equal to the number of layers needed to properly reduce the size of the target shoe to the desired size; and installing the toe engagement apparatus against the front area walls of the target shoe, thereby reducing the effective size of the target shoe without vertically cramping a user's foot;

wherein the toe engagement apparatus further comprises a floor member affixed to a longitudinal edge of at least one layer of the plurality of layers, and the step of installing including placing the floor member against an inner sole of the target shoe such that the toe engaging apparatus abuts against the front wall of the target shoe.

2. The method of claim 1, wherein the step of installing includes adhering a surface of at least one layer of the plurality of layers to the front wall of the target shoe.

3. The method of claim 1, wherein the each layer is removably held to the neighboring layer by a weak adhesive.

4. The method of claim 1, wherein at least one of the plurality of layers is made from foam.

5. The method of claim 1, wherein at least one of the plurality of layers is made from rubber.

6. The method of claim 1, wherein at least one of the plurality of layers is made from leather.

* * * * *